US010069213B2

(12) United States Patent
Song et al.

(10) Patent No.: US 10,069,213 B2
(45) Date of Patent: Sep. 4, 2018

(54) ANTENNA SYSTEM WITH BEAMWIDTH CONTROL

(71) Applicant: Quintel Technology Limited, Bristol (GB)

(72) Inventors: Peter Chun Teck Song, San Francisco, CA (US); Lance Darren Bamford, Pittsford, NY (US); David Sam Piazza, San Jose, CA (US); David Edwin Barker, Stockport (GB)

(73) Assignee: Quintel Technology Limited, Bristol (GB)

( * ) Notice: Subject to any disclaimer, the term of this patent is extended or adjusted under 35 U.S.C. 154(b) by 354 days.

(21) Appl. No.: 14/610,987

(22) Filed: Jan. 30, 2015

(65) Prior Publication Data

US 2015/0222025 A1 Aug. 6, 2015

Related U.S. Application Data

(60) Provisional application No. 61/934,472, filed on Jan. 31, 2014, provisional application No. 61/954,344, filed on Mar. 17, 2014.

(51) Int. Cl.
*H01Q 21/24* (2006.01)
*H01Q 21/26* (2006.01)
(Continued)

(52) U.S. Cl.
CPC ..... *H01Q 21/24* (2013.01); *H01Q 5/28* (2015.01); *H01Q 5/42* (2015.01); *H01Q 5/48* (2015.01); *H01Q 21/26* (2013.01); *H01Q 1/246* (2013.01)

(58) Field of Classification Search
CPC ..... H01Q 1/246; H01Q 21/24; H01Q 21/26
(Continued)

(56) References Cited

U.S. PATENT DOCUMENTS 4,686,536 A * 8/1987 Allcock ..... H01Q 9/065 343/700 MS
5,039,994 A * 8/1991 Wash ..... H01Q 9/065 343/813

(Continued)

FOREIGN PATENT DOCUMENTS

JP 2005-033261 A 2/2005
JP 2005033261 A * 2/2005

(Continued)

OTHER PUBLICATIONS

International Search Report and Written Opinion of PCT/US2015/13948, dated May 20, 2015, pp. 1-11.

(Continued)

*Primary Examiner* — Dameon E Levi
*Assistant Examiner* — Ab Salam Alkassim, Jr.

(57) ABSTRACT

In one example, the present disclosure provides a dual-polarized antenna array that includes at least one unit cell. The at least one unit cell includes at least one radiating element of a first polarization state and at least two radiating elements of a second polarization state. The second polarization state is orthogonal to the first polarization state. The at least two radiating elements of the second polarization state are displaced on a first side and a second side of the at least one radiating element of the first polarization state.

17 Claims, 10 Drawing Sheets

(51) Int. Cl.
*H01Q 5/42* (2015.01)
*H01Q 5/28* (2015.01)
*H01Q 5/48* (2015.01)
*H01Q 1/24* (2006.01)

(58) Field of Classification Search
USPC ..... 343/798, 841, 844, 853, 893
See application file for complete search history.

(56) References Cited

U.S. PATENT DOCUMENTS 6,067,053 A * 5/2000 Runyon ..... H01Q 1/246 343/700 MS
6,072,439 A * 6/2000 Ippolito ..... H01Q 1/246 343/795
6,091,365 A * 7/2000 Derneryd ..... H01Q 1/246 343/700 MS
6,195,063 B1 * 2/2001 Gabriel ..... H01Q 1/523 343/700 MS
6,339,407 B1 * 1/2002 Gabriel ..... H01Q 1/246 343/797
6,531,984 B1 * 3/2003 Johannisson ..... H01Q 9/0435 343/700 MS
6,985,123 B2 * 1/2006 Gottl ..... H01Q 21/24 343/700 MS
7,280,082 B2 * 10/2007 Theobold ..... H01Q 1/12 343/770
7,405,710 B2 * 7/2008 Bisiules ..... H01P 5/103 343/797
7,579,999 B2 * 8/2009 Boβ ..... H01Q 9/06 343/795
8,570,233 B2 * 10/2013 Lindmark ..... H01Q 1/246 343/703
8,798,679 B2 * 8/2014 Shimizu ..... H01Q 1/246 343/758
9,837,711 B2 * 12/2017 Shtrom ..... H01Q 3/24
9,859,611 B2 * 1/2018 Jones ..... H01Q 1/246
2002/0171601 A1 * 11/2002 Puente Baliarda .... H01Q 1/246 343/893
2003/0011529 A1 * 1/2003 Gottl ..... H01Q 1/246 343/795
2003/0090431 A1 * 5/2003 Gottl ..... H01Q 1/246 343/797
2003/0227420 A1 * 12/2003 Roper ..... H01Q 3/267 343/797
2004/0222937 A1 * 11/2004 Gottl ..... H01Q 1/246 343/797
2004/0264592 A1 * 12/2004 Sibecas ..... H01Q 21/24 375/267
2005/0040994 A1 * 2/2005 Mazoki ..... G06K 19/07786 343/809
2006/0114168 A1 * 6/2006 Gottl ..... H01Q 1/246 343/797
2006/0244675 A1 * 11/2006 Elliot ..... H01P 1/18 343/853
2007/0030208 A1 * 2/2007 Linehan ..... H01Q 1/246 343/757
2007/0229385 A1 * 10/2007 Deng ..... H01Q 1/246 343/797
2008/0074339 A1 * 3/2008 Lee ..... H01Q 9/26 343/803
2008/0204318 A1 * 8/2008 Thomas ..... H01Q 1/246 342/361
2009/0058752 A1 * 3/2009 Lee ..... H01Q 9/26 343/817
2009/0135078 A1 * 5/2009 Lindmark ..... H01Q 1/523 343/844
2009/0278759 A1 * 11/2009 Moon ..... H01Q 1/246 343/810
2010/0127949 A1 * 5/2010 Shimizu ..... H01Q 1/246 343/810
2010/0225563 A1 * 9/2010 Lin ..... H01Q 1/422 343/909
2010/0238087 A1 * 9/2010 Jung ..... H01Q 3/30 343/810
2010/0271276 A1 * 10/2010 Lee ..... H01Q 21/26 343/742
2011/0148730 A1 * 6/2011 Gottl ..... H01Q 1/246 343/793
2011/0175782 A1 * 7/2011 Choi ..... H01Q 1/246 343/798
2011/0267248 A1 * 11/2011 Remski ..... H01Q 13/10 343/770
2011/0291905 A1 * 12/2011 Liu ..... H01Q 19/10 343/797
2012/0033759 A1 * 2/2012 Goransson ..... H01Q 3/267 375/296
2012/0062440 A1 * 3/2012 Tasaki ..... H01Q 1/246 343/841
2012/0108297 A1 * 5/2012 Petersson ..... H01Q 1/246 455/562.1
2012/0176945 A1 * 7/2012 Hartenstein ..... H04B 7/0413 370/297
2013/0044035 A1 * 2/2013 Zhuang ..... H01Q 9/0428 343/770
2013/0063310 A1 * 3/2013 Mak ..... H01Q 1/246 343/700 MS
2014/0139387 A1 5/2014 Jones et al.
2014/0354510 A1 * 12/2014 Li ..... H01Q 25/001 343/876
2015/0015440 A1 * 1/2015 Montgomery ..... H01Q 15/248 342/361
2015/0022409 A1 * 1/2015 Milroy ..... H01Q 15/242 343/756
2015/0162665 A1 * 6/2015 Boryssenko ..... H01Q 1/48 343/797
2015/0222022 A1 * 8/2015 Kundtz ..... H01Q 21/24 343/771
2016/0156109 A1 * 6/2016 Anderson ..... H01Q 21/0093 343/852
2017/0025767 A1 * 1/2017 Elsallal ..... H01Q 3/30
2017/0256859 A1 * 9/2017 Boryssenko ..... H01Q 1/48
2017/0310009 A1 * 10/2017 Isik ..... H01Q 5/49
2017/0324171 A1 * 11/2017 Shehan ..... H01Q 21/0031

FOREIGN PATENT DOCUMENTS

WO WO 98/27614 A1 6/1998
WO WO 9827614 A1 * 6/1998 ..... H01Q 13/22

OTHER PUBLICATIONS

Supplemental Partial European Search Report for corresponding application EP15743325, dated Aug. 23, 2017, 11 Pages.
Communication pursuant to Rules 70(2) and 70a(2) EPC—supplementary European search report—dated Jan. 5, 2018 for corresponding EP15743325.1. 12 Pages.
Communication pursuant to Rules 70(2) and 70a(2) EPC—Supplementary European Search Report—dated Jan. 5, 2018 for corresponding EP15743325.1, 12 Pages.

* cited by examiner

200

400

600

800

ANTENNA SYSTEM WITH BEAMWIDTH CONTROL

CROSS REFERENCE TO RELATED APPLICATIONS

This application claims priority to U.S. Provisional Patent Application Ser. No. 61/934,472, filed Jan. 31, 2014, which is herein incorporated by reference in its entirety. This application also claims priority to U.S. Provisional Patent Application Ser. No. 61/954,344, filed Mar. 17, 2014, which is herein incorporated by reference in its entirety.

FIELD OF THE DISCLOSURE

The present disclosure relates generally to cross-polarized antenna arrays, and more specifically to antenna arrays with narrow beamwidth and efficient packing of antenna elements.

BACKGROUND

Cellular base station sites are typically designed and deployed with three sectors arranged to serve different azimuth bearings, for example each sector serving a 120 degree range of angle from a cell site location. Each sector includes an antenna with an azimuthal radiation pattern which defines the sector coverage footprint. The half-power beamwidth (HPBW) of the azimuth radiation pattern of a base station sector antenna is generally optimal at around 65 degrees as this provides sufficient gain and efficient tri-sector site tessellation of multiple sites in a network or cluster of sites serving a cellular network area.

Most mobile data cellular network access technologies including High Speed Packet Access (HSPA) and Long Term Evolution (LTE) employ 1:1 or full spectrum re-use schemes in order to maximise spectral efficiency and capacity. This aggressive spectral re-use means that inter-sector and inter-cell interference needs to be minimised so that spectral efficiency can be maximised. Antenna tilting, normally delivered by electrical phased array beam tilt provides a network optimisation freedom to address inter-cell interference, but few options exist to optimise inter-sector interference. The Front-to-Back (FTB), Front-to-Side (FTS) and Sector Power Ratio (SPR) of an antenna pattern are parameters which indicate the amount of inter-sector interference; the larger the FTB and FTS and the lower the SPR value, the lower the inter-sector interference.

One way to improve network performance is by effective control of the azimuth beamwidth of the base station antenna. This azimuth beamwidth is typically measured at the minus 3 dB position for HPBW, and minus 10 dB for FSR. In most cellular deployment, the HPBW is typically required at 65 degrees, while the FSR beamwidth is set at 120 degrees to ensure that power does not spill over to adjacent cells, therefore maintaining a good carrier-to-interference (C/I) ratio.

Reducing the 3 dB azimuth beamwidth to 60 degrees or even 55 degrees typically improves the SPR, but may also impact cellular network tessellation efficiency for basic service coverage, and necessarily requires a wider antenna to achieve the narrower beamwidth which then places additional pressure on the site in terms of zoning, wind-loading and rentals. For instance, base station antennas with variable azimuth beamwidths are available which can be used to provide better load balancing between sectors and to adjust sector to sector overlap. However, such solutions may not be suitable for accommodating multiple arrays and hence supporting multiple spectrum bands which is a desirable requirement for base station antennas. In addition, such variable beamwidth antennas can be large (the size being governed by the minimum achievable beamwidth) with some solutions requiring mechanical and active electronics and hence potentially costly to deploy and maintain.

SUMMARY

In one example, the present disclosure provides a dual-polarized antenna array that includes at least one unit cell. The at least one unit cell includes at least one radiating element of a first polarization state and at least two radiating elements of a second polarization state. The second polarization state is orthogonal to the first polarization state. The at least two radiating elements of the second polarization state are displaced on a first side and a second side of the at least one radiating element of the first polarization state.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
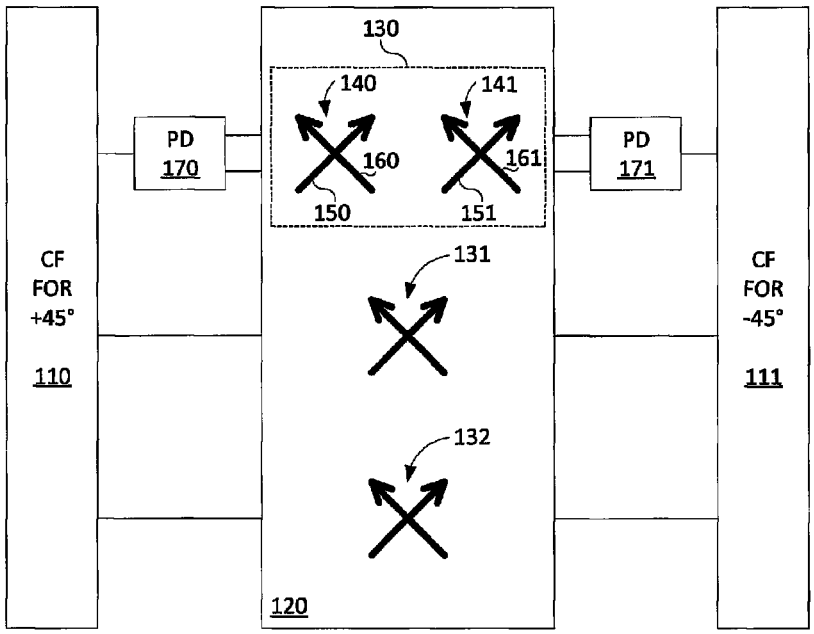
FIG. 1 depicts a base station antenna array system, according to the present disclosure.

The present disclosure relates to antenna arrays suitable for cellular base station deployments which can provide enhanced mitigation of inter-sector interference or adjustable sector overlap for optimising a cellular network design.

In particular, the present disclosure provides a solution to control azimuth radiation pattern roll-off rate, Half Power Beamwidth (HPBW), Front-to-Side Ratio (FSR) and Sector Power Ratio (SPR). Antenna arrays of the present disclosure are particularly suitable for use in a sectored base station site, where inter-sector interference is limited by the azimuth radiation characteristics of the base station antenna. As used herein, the terms "antenna" and "antenna array" are used interchangeably. For consistency, and unless otherwise specifically noted, with respect to any of the antenna arrays depicted the real-world horizon is indicated as left-to-right/right-to-left on the page, and the up/vertical direction is in a direction from the bottom of the page to the top of the page.

Conventionally, positioning of the antenna elements over the reflector, selection of the height of the elements and dimensions of the reflector and active electronics have been used to control the azimuth beamwidth of the antenna. Thus, for example, a wider antenna is used to achieve narrower beamwidth, which places additional pressure on the site in terms of zoning, wind-loading, rentals and so forth. In contrast, in one embodiment of the present disclosure an antenna array comprises a plurality of unit cells arranged vertically along the length of the array. In one embodiment each unit cell comprises at least two radiating elements, e.g., centred along the width of the reflector. In one embodiment, each unit cell radiates a dual orthogonal linear polarization field, e.g., +45 degree and −45 degree slant polarizations (e.g., as preferred in conventional cellular communication systems). However, in one embodiment, the radiating elements of each unit cell are physically orientated orthogonally at zero degrees and +90 degrees. To achieve the +/−45 degree radiation vectors/fields, a "virtual cross-polarization" technique is used where the vertical element (oriented at 90 degrees) and horizontal element (oriented at zero degrees) are fed in co-phase power or anti-phase power to achieve vector rotation. In one embodiment the +90 degree element, or "vertical element", is further separated into at least two radiating elements, or a vertical radiating pair. The vertical radiating pair is disposed horizontally within the unit cell, with a maximum horizontal separation equivalent to the width of the reflector. The vertical radiating pair is co-phased to realize an array factor in the azimuth plane where the HPBW and FSR are significantly reduced. Notably, the use of the "virtual cross-polarization" technique coupled with the novel unit cell geometry gives enhanced control over the HPBW/FSR and SPR parameters, for optimized cellular network deployment.

In addition, an antenna array comprising one or more "H" shaped unit cells, is suitable for optimized element packing in integrated arrays (e.g., dual-band or multi-band arrays). For example, controlling the ratio of the types of unit cells used in the array plus vertical component spacing on the 'H' shaped unit cell gives additional design and performance freedoms for the ability to tailor the azimuth radiation pattern shape to a specified requirement. At the same time, "shadowing effects" are minimised on adjacent integrated array faces. These and other advantages of the present disclosure are described in greater detail below in connection with the examples of the following figures.

Referring now to FIG. 1, in one embodiment, a base station antenna array system 100 according to the present disclosure includes two corporate feed (CF) networks (110) and (111) which convert base station radio frequency (RF) signals into antenna element drive signals for a number of dual-linearly polarized unit cells (130-132) disposed vertically along the length of the antenna array 120. Each unit cell 130-132 radiates a dual orthogonal linear polarization field, e.g., in preferred +45 degree and −45 degree slant polarization radiating vectors. Notably, unit cell 130 is shown including two +45/−45 degree oriented dual linearly polarized cross-dipole antenna elements 140 and 141 which are horizontally disposed. Each of the antenna elements 140 and 141 in unit cell 130 include two radiating elements, a +45 degree radiating element (150 and 151 respectively) and a −45 degree radiating element (160 and 161 respectively), which are fed from the respective CF networks 110 and 111 via power dividers (PD) 170 and 171 respectively to provide an equal phase and amplitude split of the signal before feeding into the pairs of radiating elements (150, 160 and 151, 161). This results in forming an array factor in the azimuth plane. Depending on the separation of the antenna elements 140 and 141 in unit cell 130, the azimuth radiation patterns from unit cell 130 can be optimized. For instance, if the two horizontally disposed antenna elements 140 and 141 are spaced at 0.8λ of the operating frequency, the resultant azimuth beamwidth is typically half of the azimuth beamwidth of an un-split unit cell (e.g., a "single" dual-polarized cross-dipole antenna element, such as in unit cell 131 or 132). In one embodiment, the combination of a number of split and un-split unit cells disposed vertically along the antenna array will enable a desired overall array beamwidth to be selected. However, a disadvantage of this array topology is that a much wider antenna solution is required to accommodate the two horizontally displaced +45/−45 degree oriented dual-polarized cross-dipole antenna elements.

Figure 2:
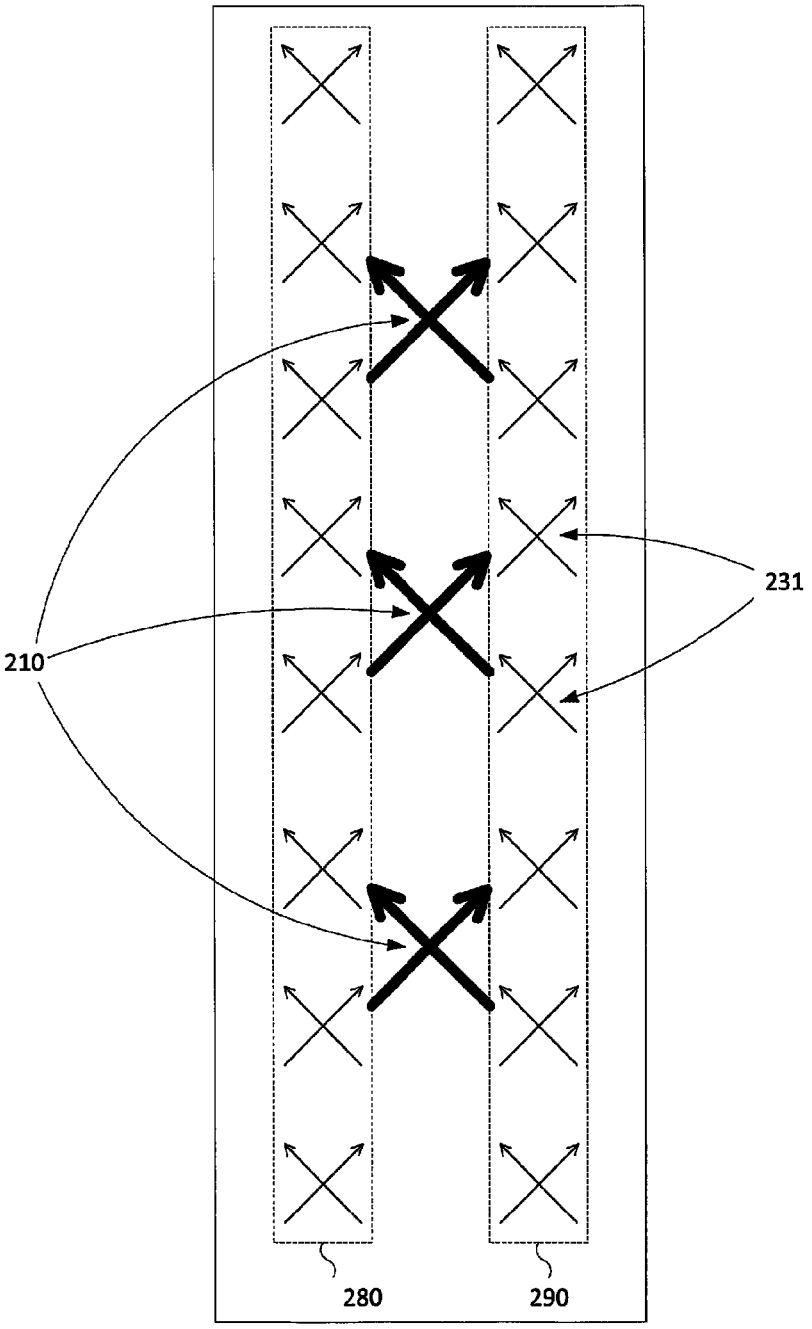
FIG. 2 depicts a dual-band base station antenna, according to the present disclosure.

With reference to FIG. 2, many base station antennas may include a dual-band combined array with two array columns or stacks of antenna elements, one stack for low-band operation (e.g., 690-960 MHz), and one stack for high-band operation (e.g., 1695-2690 MHz). More complex base station antennas may include three stacks as shown in the dual-band antenna array 200 of FIG. 2 where the low-band stack of dual-polarized antenna elements 210 are positioned in the center of the reflector while two high-band array stacks 280 and 290 are located on each side of the low-band elements 210 (for ease of illustration, only two of the high-band dual-polarized antenna elements 231 are labeled in the figure). This clearly illustrates some of the limitations of the space available on the reflector where shadowing and mutual interaction effects between the low-band and high-band elements can degrade the antenna performance. The shadowing between elements can be mitigated if the separation between the two high-band stacks 280 and 290 is increased. However, this is generally disadvantageous since this would result in a much wider antenna platform.

Figure 3:
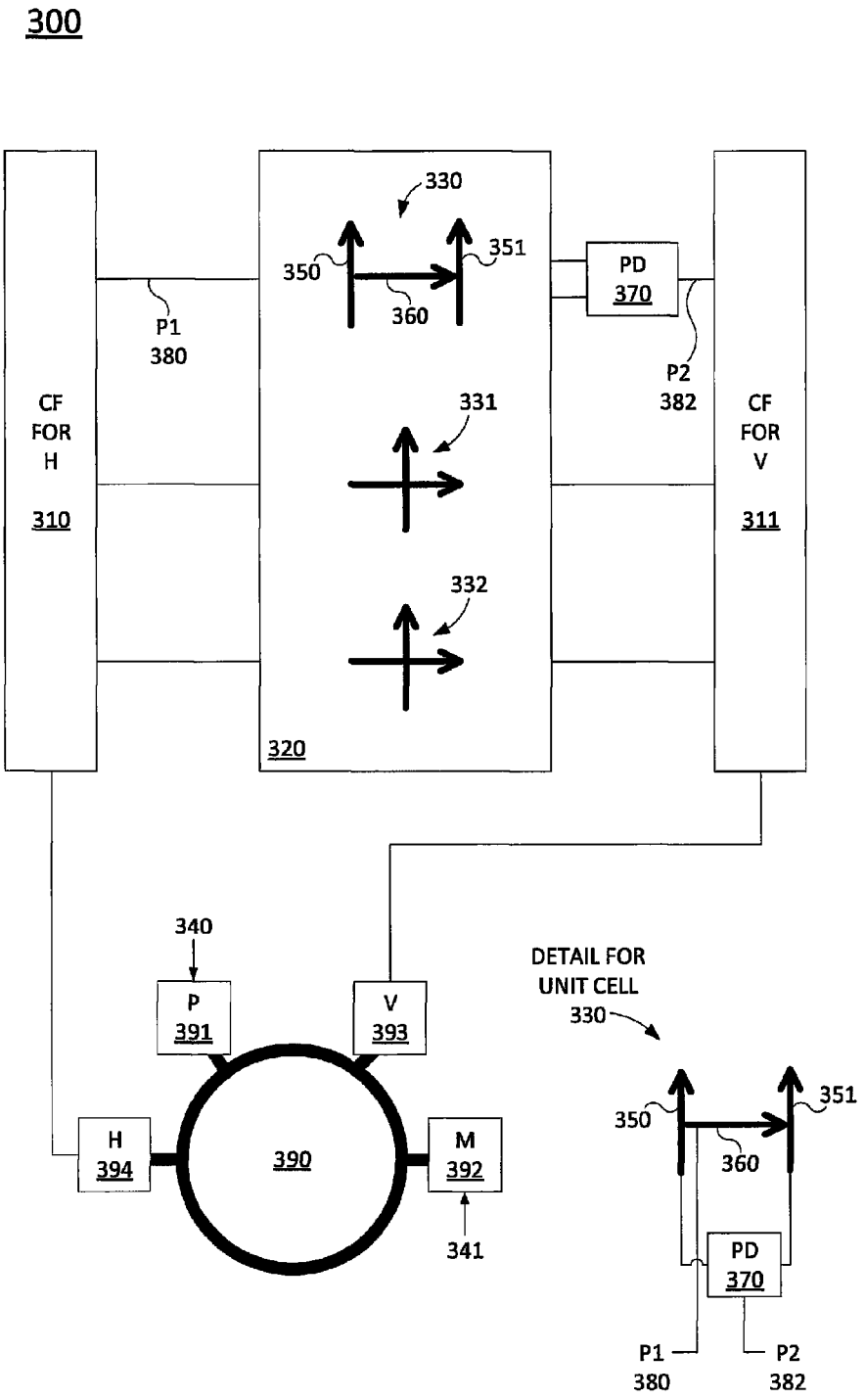
FIG. 3 depicts another base station antenna array system, according to the present disclosure.

FIG. 3 illustrates a base station antenna array system 300 where each of the unit cells 330-332 of the antenna array 320 includes orthogonal radiating elements oriented at zero degrees and 90 degrees, or in a horizontal/vertical (HN) orientation. Notably, unit cell 330 includes two split-vertical-oriented radiating elements 350 and 351 to form an azimuth array factor. The horizontally oriented antenna element 360 in the unit cell 330 remains in the same position as in a conventional dual-polarised cross-dipole with H/V orientation (such as in unit cell 331 or 332), while the two split-vertical-oriented radiating elements 350 and 351 are disposed to either side of the horizontally oriented antenna element 360 (i.e., situated at both ends of the horizontally oriented antenna element 360).

To achieve the preferred radiation pattern of +45/−45 degree slant linear polarizations desired for base station antennas, the orthogonal HN oriented radiating elements are fed in-phase (i.e., where an information signal from CF network 310 fed through port P1 380 is equally phased to a copy of the information signal sent through port P2 382 from CF network 311 to achieve a resultant or virtual +45 degrees slant linear polarization vector and fed in anti-phase (i.e., where an information signal fed through port P2 382 comprises an out-of-phase, or delayed version of the same information signal fed through port P1 380) to generate a −45 degree slant linear polarization vector. This is shown in the detail for unit cell 330 shown in FIG. 3. A power divider 370 provides an equal phase and amplitude split of the signal from port P2 382 to the split-vertical-oriented radiating elements 350 and 351. Thus, the vertical radiating elements and the horizontal radiating elements of each unit cell 330-332 are physically oriented orthogonal to one another, and also transmit and/or receive via orthogonal +45/−45 degree slant linear polarization radiating vectors.

In one embodiment, this is achieved by feeding the elements via a microwave circuit such as a 180 degree hybrid/ring coupler (or hybrid combiner), a rat race coupler, a digital signal processing circuit and/or a software implemented solution. For instance, the relative phasing and power dividing for the feed signals provides a virtual rotation of the radiating vectors from the radiating elements of each unit cell 330-332 to the desired +45/−45 degree slant linear polarisations.

To illustrate, FIG. 3 also includes a circuit, or power divider 390 for rotating, or controlling the effective radiating vectors of each of the horizontal-oriented and vertical-oriented radiating elements of each of the unit cells 330-332. In one example, the power divider 390 comprises a hybrid coupler or a (180 degree) hybrid ring coupler, such as a rat-race coupler, each of which may also be referred to herein as a hybrid combiner. As shown in FIG. 3, power divider 390 includes two input ports (assuming connection to signals intended for transmission), designated as positive 'P' input port 391 (also referred to herein as an in-phase input) and minus 'M' input port 392 (also referred to herein as an out-of phase input) and two output ports, designated as 'V' output port 393 and 'H' output port 394. For example, the signals 340 and 341 input at positive 'P' input port 391 and minus 'M' input port 392 respectively, may be for transmission at +45 and −45 degree linear slant polarizations, respectively. To illustrate this, consider signal 340 which is input at the positive input port 391, enters the power divider 390, which in this case is a 180-degree hybrid ring coupler, splits power equally into two branches with one branch traveling clockwise to output port 'V' labeled 393 and the other branch traveling counterclockwise to output port 'H' labeled 394. Notably, the distance between the positive input port 391 and the 'H' port 394 and the distance between the positive input port 391 and the 'V' port 393 are the same distance. In one example, this distance is at or substantially close to a distance that is the equivalent of 90 degrees of phase for a center frequency within a frequency band of the signals to be transmitted and received via the radiating elements of unit cells 330-332. In any case, since the signal 340 received at input port 391 travels the same distance, the two output ports 393 and 394 receive identical signals of the same power and same phase (e.g., these are two "co-phased" component signals). Similarly, signal 341 received at minus input port 392 enters the power divider 390, splits power equally into two branches with a branch traveling clockwise and a branch travelling counterclockwise. Notably, the distance between the minus input port 392 and the 'V' port 393 is the same distance as between the positive input port 391 and the 'V' output port 393, for instance, a distance that provides for 90 degrees of phase shift. Thus, the signal 341 from the minus input port 392 arrives as the 'V' output port 393 having a same phase as the signal 340 on the positive input port 391. However, in one example, the distance between the minus input port 392 and the 'H' output port 394 is three times the distance between the minus input port 392 and the 'V' port 393. For instance, this distance may be a distance or length that provides for 270 degrees of phase shift, e.g., for a signal at a center frequency of a desired frequency band. In other words, when the signal 341 from the minus input port 392 arrives at the 'H' port 394, it is 180 degrees out of phase with respect to the signal 340 that arrives at the 'H' output port 394 from the positive input terminal 391. In addition, since the signal 341 received at input port 392 travels a different distance to the two output ports 393 and 394, the output ports receive signals of the same power but 180-degrees out-of-phase (e.g., these are two "anti-phased" component signals).

As described above, the 'H' output port 394 and the 'V' output port 393 receive signals 340 and 341 from the positive input terminal 391 and minus input terminal 392, respectively. These signals are combined at the respective output terminals 393 and 394 and forwarded to the CF networks 310 and 311 respectively. The signals may then be passed from CF networks 310 and 311 to the respective horizontal-oriented and vertical-oriented radiating elements of the unit cells 330-332. However, prior to driving the split-vertical-oriented radiating elements 350 and 351 of unit cell 330, the signal form CF network 311 via port P2 382 may be further processed by the power divider 370 to provide two equal amplitude, in-phase antenna element drive signals.

FIG. 3 also depicts the array 320 with a combination of "H" shaped unit cells (e.g., unit cell 330), with split-vertical radiating elements, and non-split-vertical unit cells/antenna elements (e.g., unit cells 331 and 332). For example, unit cell 331 and unit cell 332 in FIG. 3 are shown using non-split H/V oriented radiating elements, and although not shown, would be fed from the respective corporate feed (CF) networks 310 and 311 such as to deliver virtual +45/−45 degree slant linear polarizations. Advantageously, the embodiment of FIG. 3 allows the array face to be physically narrower compared to a more conventional base station antenna array with physically orientated +45/−45 degree dual-polarized antenna elements. This is particularly beneficial on deployments where wind loading at base station sites is critical.

Figure 4:
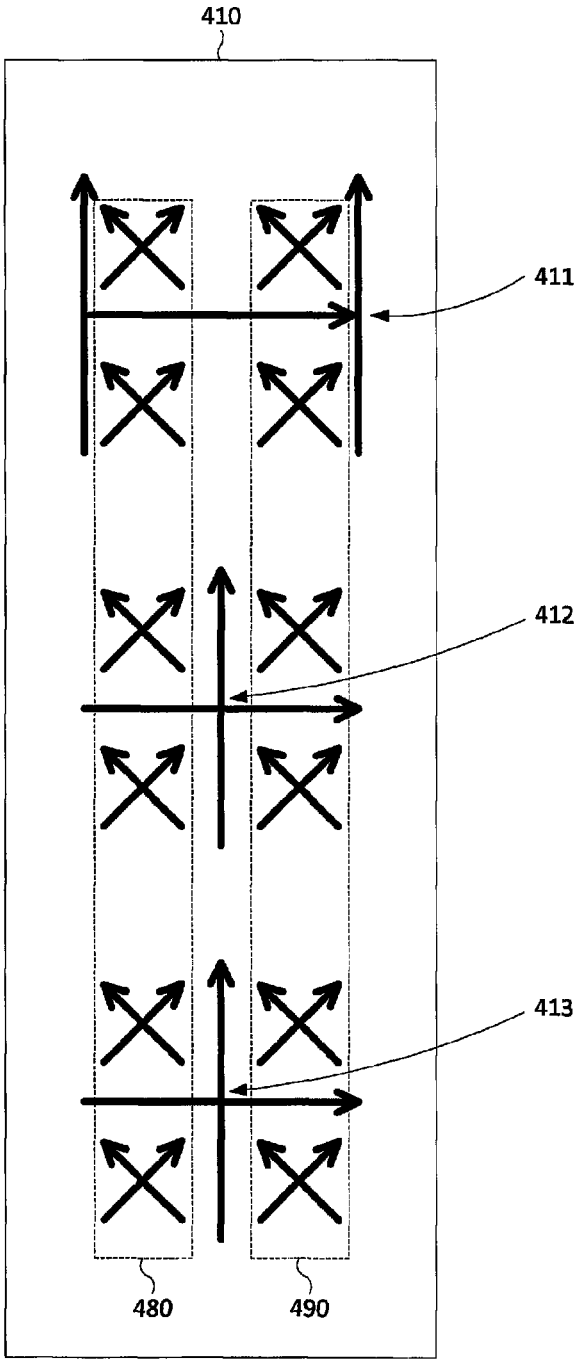
FIG. 4 depicts another dual-band base station antenna according to the present disclosure.

Referring now to FIG. 4, embodiments of the present disclosure also enable co-location of multiple high-band array stacks with a low-band array stack in a limited reflector space. Typical low-band and high-band frequency ranges are mentioned above in connection with FIG. 2. However, it should be understood that the present disclosure is not limited to any particular frequencies or frequency ranges and that the mentioning of any specific values are for illustrative purposes only. FIG. 4 shows an example of a three stack antenna array 400 where the two stacks 480 and 490 of high-band elements are packed efficiently amongst a low-band stack 410 comprising the split low-band element 411 and non-split low-band elements 412 and 413. Note that the resulting array face topology has low-band elements which do not shadow the high-band elements. By avoiding a shadowing effect on the high-band elements, mutual coupling between the low-band and the high-band antenna elements can be reduced. Notably, the low-band elements 411-413 may be fed via the same or similar corporate feeds as illustrated in FIG. 3, and may provide the same +45/−45 degree slant linear polarization virtually rotated effective radiating vectors. However, since the high-band antenna elements of high-band arrays 480 and 490 may comprise cross-dipoles with radiating elements physically oriented at +45/−45 degrees, the high-band antenna elements may be fed via conventional means.

Figure 5A:
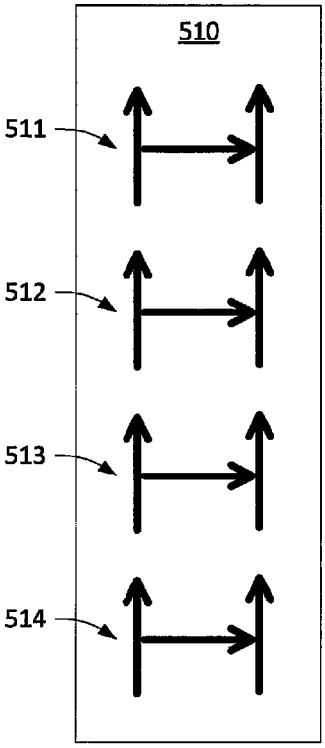
FIGS. 5A, 5B and 5C depict examples of antenna arrays having unit cells with split-vertical-oriented radiating elements in various arrangements, according to the present disclosure.
Figure 5B:
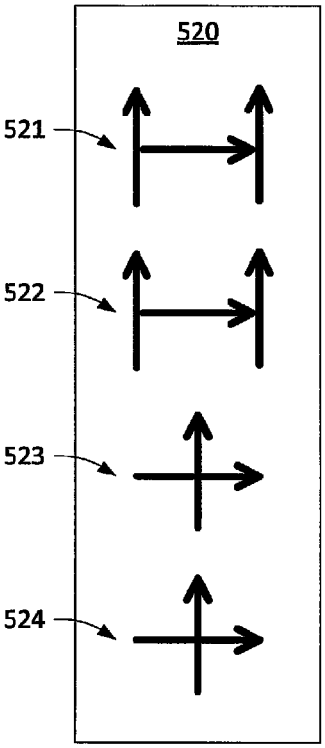
Figure 5C:
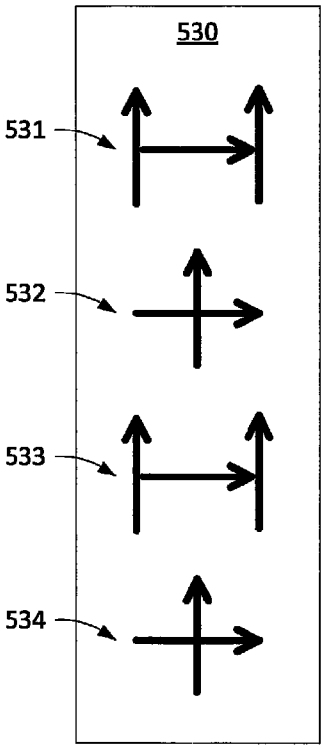

FIGS. 5A, 5B and 5C illustrate further embodiments of the present disclosure where the number of "H" shaped unit cells having split-vertical-oriented polarized radiating elements, and their positions along the vertical length of the antenna array are varied. For example, FIG. 5A illustrates "H" shaped split unit cells 511-514 distributed along the length of the antenna array 510. FIG. 5B illustrates a combination of split unit cells (521 and 522) and non-split unit cells (523 and 524) along the length of the antenna array 520. FIG. 5C illustrates alternating split unit cells (531 and 533) and non-split unit cells (532 and 534) along the length of the antenna array 530. Notably, by varying the number and positions of split and non-split unit cells, different desired azimuth beamwidths are achieved. In addition, any of the examples of FIGS. 5A-5C may also be implemented in dual-band and multi-band antenna arrays, e.g., similar to the embodiment of FIG. 4.

Figure 6:
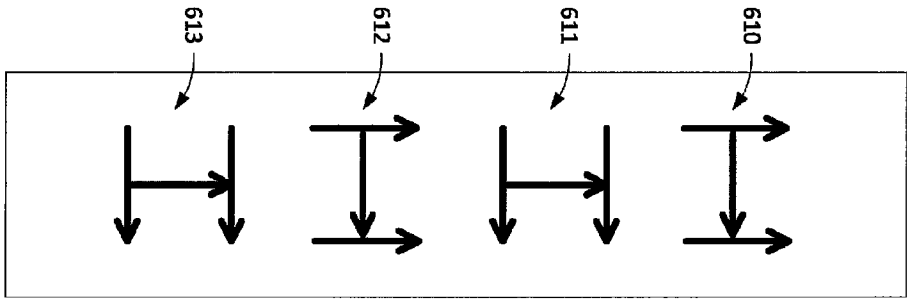
FIG. 6 illustrates an antenna array having split horizontal-oriented radiating elements, according to the present disclosure.

FIG. 6 illustrates a further embodiment where an antenna array 600 includes one or more unit cells featuring split-horizontal-oriented radiating elements, e.g., unit cells 611 and 613. Notably, while inclusion of unit cells having split-vertical-oriented polarized radiating elements, e.g., unit cells 610 and 612, can be used to control azimuth beamwidth, unit cells having split-horizontal-oriented polarized radiating elements, e.g., unit cells 611 and 613 can be used to control elevation beamwidth, e.g., based upon the number of unit cells having split-horizontal-oriented polarized radiating elements, the locations of such unit cells with the stack, and so forth.

Figure 7A:
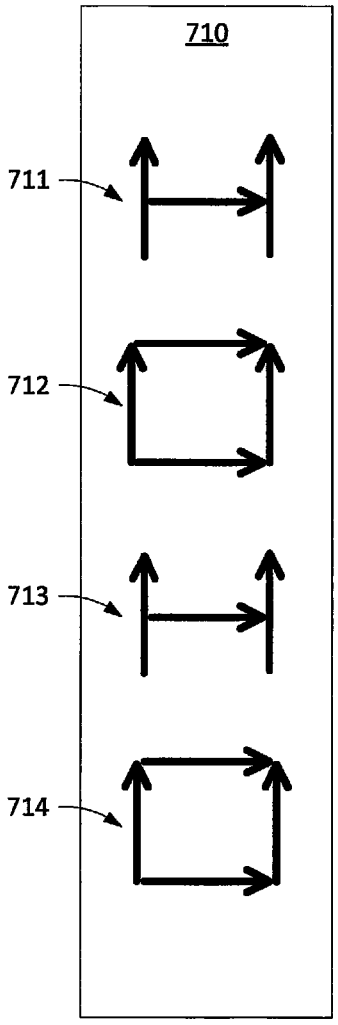
FIGS. 7A and 7B depict antenna arrays having dual-polarised unit cells which include both split-vertical-oriented and split-horizontal-oriented radiating elements, according to the present disclosure.
Figure 7B:
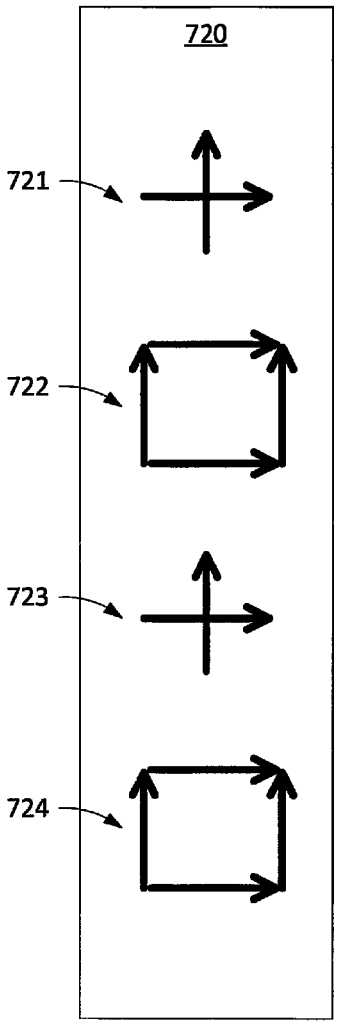

FIGS. 7A and 7B illustrate antenna arrays having dual-polarised unit cells which include both split-vertical-oriented and split-horizontal-oriented radiating elements. FIGS. 7A and 7B also show arrangements where dual-polarised unit cells having both split-vertical-oriented and split-horizontal-oriented radiating elements are included in arrays with vertical-split-oriented antenna elements as well as with standard HN oriented dual-polarised antenna elements. For example, FIG. 7A illustrates antenna array 710 with split-vertical-oriented antenna elements 711 and 713 alternated with horizontal and vertical split antenna elements 712 and 714. FIG. 7B illustrates antenna array 720 with standard HN oriented antenna elements 721 and 723 alternated with horizontal and vertical split antenna elements 722 and 724. Again, various combinations of different types of unit cells, e.g., with +45/−45 degree oriented antenna elements, standard H/V oriented antenna elements, split vertical antenna elements, split horizontal antenna elements, antenna elements with both split vertical and split horizontal radiating elements, and the like may be utilized in an antenna array/antenna stack for both azimuth and elevation beamwidth control, Half Power Beamwidth (HPBW), Front-to-Side Ratio (FSR), Sector Power Ratio (SPR) and so forth.

Figure 8:
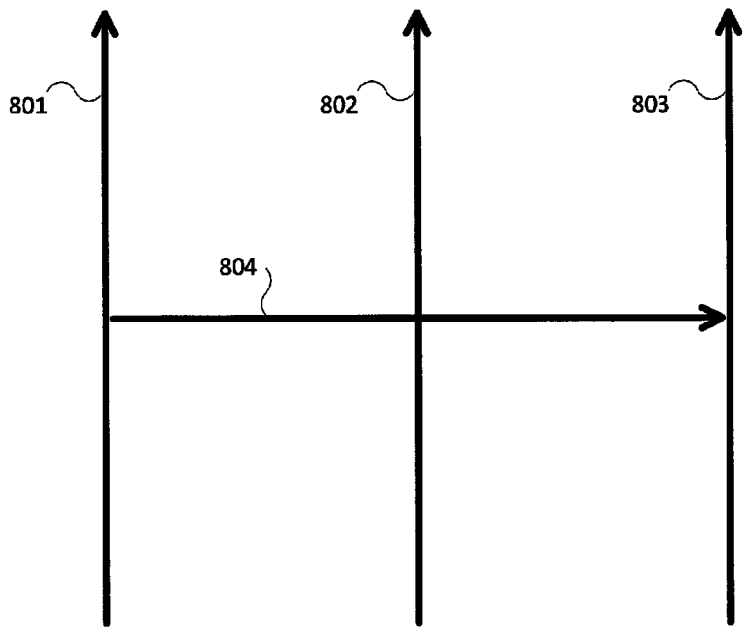
FIG. 8 depicts a unit cell including three split-vertical-oriented radiating elements, according to the present disclosure.

FIG. 8 illustrates a further embodiment of the present disclosure where a unit cell 800 includes three split-vertical-oriented radiating elements 801, 802 and 803 disposed at various positions along a horizontal radiating element 804. Notably, by varying the spacing of the respective vertical radiating elements (e.g., between 801 and 802, between 802 and 803 and between 801 and 803), additional azimuthal radiation patterns are made available to cellular base station designers and operators.

Figure 9:
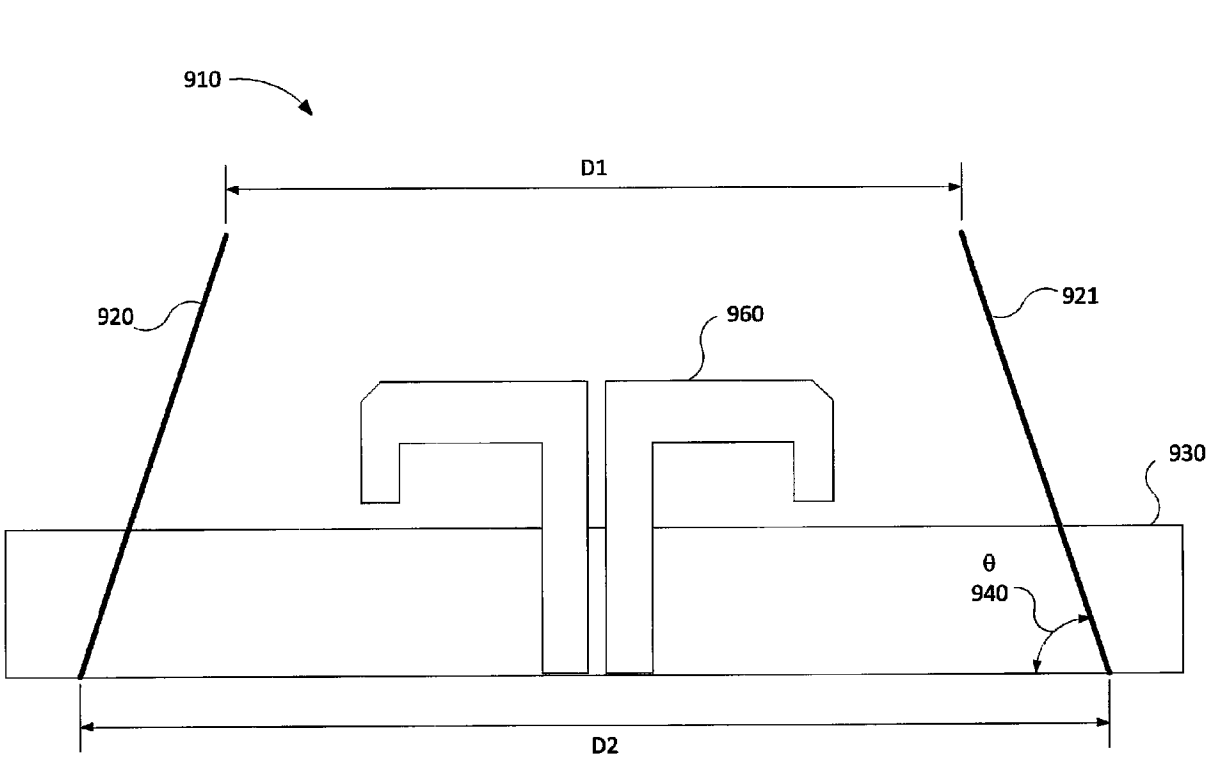
FIG. 9 depicts a top-down view of an antenna array having a unit cell with split-vertical-oriented radiating elements, according to the present disclosure.

FIG. 9 illustrates still another embodiment of the present disclosure having a unit cell 910 with split-vertical-oriented radiating elements 920 and 921, where it is shown (looking down an antenna array 900 from the top) that the vertically oriented split elements 920 and 921 are mounted at a horizontal distance of D2, typically just shorter than the width of the overall antenna reflector 930 to obtain maximum aperture of the azimuth array factor. The horizontal radiating element is shown by reference numeral 960. The vertically oriented elements 920 and 921 can be mounted at a fold angle 940 determined by Θ giving a separation distance of D1 of the radiating parts of the vertically oriented radiating elements. This is such that the vertically oriented radiating elements 920 and 921 can be efficiently packaged within a preferred profile of the radome encapsulating the antenna 900 to minimize frontal wind loading of the antenna. In particular, the vertically oriented radiating elements 920 and 921 may be inclined at angles away from an angle perpendicular to a plane of an array face ground plane of the antenna array 900.

Figure 10A:
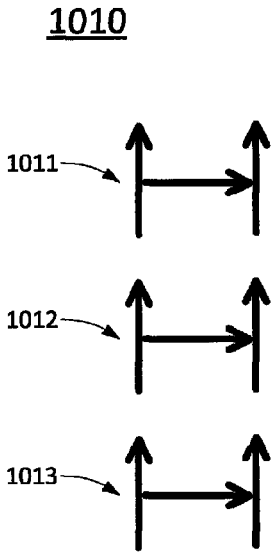
FIG. 10A depicts an antenna array having unit cells comprising split-vertical-oriented radiating elements.
Figure 10B:
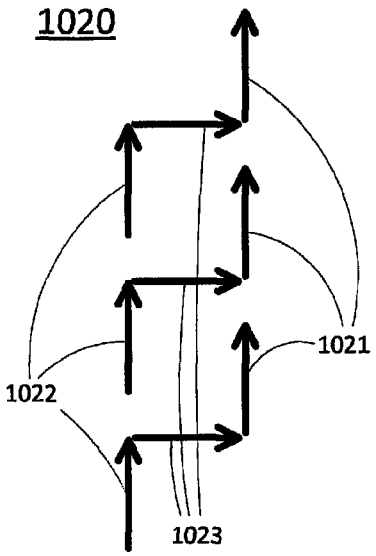
FIGS. 10B-10D depict antenna arrays having split-vertical-oriented radiating elements where the vertical oriented radiating elements of each unit cell are displaced in opposite vertical directions.
Figure 10C:
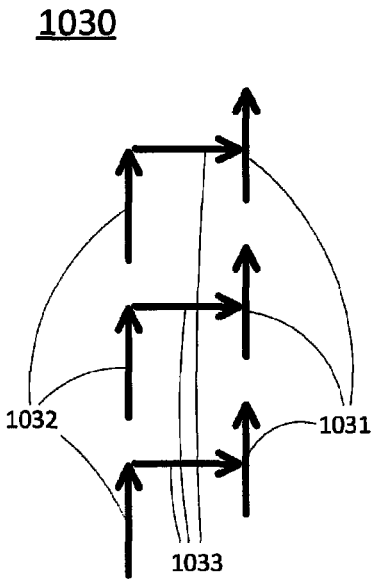
Figure 10D:
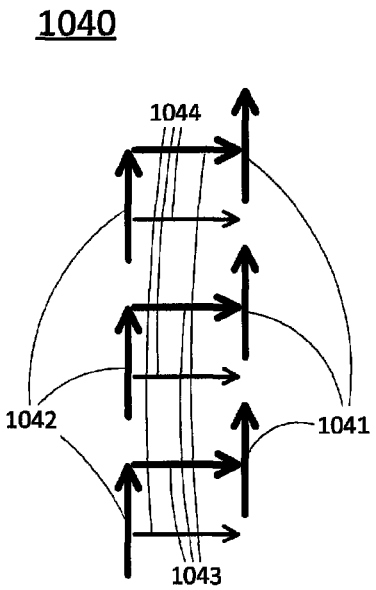

FIGS. 10A-10D are intended to illustrate additional embodiments of the present disclosure where split-vertical-oriented radiating elements are displaced vertically to various positions with respect to horizontal-oriented radiating elements. For purposes of comparison, FIG. 10A shows an antenna array 1010 with vertical split antenna elements 1011-1013. FIG. 10B shows an antenna array 1020 where sets of split-vertical-oriented radiating elements 1021 and 1022 are displaced in opposite directions centered on the respective horizontal-oriented radiating elements 1023. FIG. 10C shows an antenna array 1030 where horizontal-oriented radiating elements 1033 are aligned with the mid-points of split-vertical-oriented radiating elements 1031 and with the ends of the split-vertical-oriented radiating elements 1032. FIG. 10D illustrates an antenna array 1040 which is similar to the antenna array 1030 of FIG. 10C, with additional horizontal-oriented radiating elements 1044 added. The sets of split-vertical-oriented radiating elements 1041 and 1042 and horizontal-oriented radiating elements 1043 are similar to the corresponding components in FIG. 10C. The examples of FIGS. 10B-10D provide additional options for array topology packing, in addition to the example of FIG. 10A and the examples of the figures discussed above.

It should be noted that examples of the present disclosure describe the use of +45/−45 degree slant linear polarizations. However, although linear polarization is typical, and examples are given using linear polarizations, other embodiments of the present disclosure can be readily arrived at, for example including dual-orthogonal elliptical polarization, or left hand circular and right hand circular polarizations, as will be appreciated by those skilled in the art.

While the foregoing describes various examples in accordance with one or more aspects of the present disclosure, other and further example(s) in accordance with the one or more aspects of the present disclosure may be devised without departing from the scope thereof, which is determined by the claim(s) that follow and equivalents thereof.

What is claimed is:

1. A dual-polarized antenna array, comprising:

at least one unit cell for operation in a first frequency band, wherein the at least one unit cell includes:

at least one radiating element of a first polarization state and at least two radiating elements of a second polarization state, the second polarization state being orthogonal to the first polarization state, and wherein the at least two radiating elements of the second polarization state are displaced on a first side and a second side of the at least one radiating element of the first polarization state; and at least one dual-polarized cross-dipole antenna element for operation in the first frequency band, wherein the at least one dual-polarized cross-dipole antenna element and the at least one unit cell are oriented vertically along a length of the dual-polarized antenna array.

2. The dual-polarized antenna array of claim 1, where the first polarization state is a horizontal linear polarization and the second polarization state is a vertical linear polarization.

3. The dual-polarized antenna array of claim 1, where the first polarization state is a vertical linear polarization and the second polarization state is a horizontal linear polarization.

4. The dual-polarized antenna array of claim 1, further comprising:

a first radio frequency hybrid combiner, where a first signal intended for transmission or reception by the at least one unit cell at a first 45 degree slant linear polarization is split into two co-phased component signals by connection to an in-phase input of the first radio frequency hybrid combiner, where a first co-phased component signal of the first signal is used as a drive signal for the at least one radiating element of the first polarization state and a second co-phased component signal of the first signal is further split by a power divider to drive the at least two radiating elements of the second polarization state, and where a second signal intended for transmission or reception by the at least one unit cell at a second 45 degree slant linear polarization is split into two anti-phased component signals by connection to an out-of-phase input of the first radio frequency hybrid combiner, where the second 45 degree slant linear polarization is orthogonal to the first 45 degree slant linear polarization, where a first anti-phased component signal of the second signal is used as a drive signal for the at least one radiating element of the first polarization state and a second anti-phased component signal of the second signal is further split by the power divider to drive the at least two radiating elements of the second polarization state.

5. The dual-polarized antenna array of claim 4, where the first signal intended for transmission or reception by the unit cell and the second signal intended for transmission or reception by the unit cell are designed to be either orthogonally circular polarized, orthogonally elliptical polarized or other orthogonally linear polarized states.

6. The dual-polarized antenna array of claim 4, wherein the at least one radiating element of the first polarization state comprises:

at least two radiating elements of the first polarization state.

7. The dual-polarized antenna array of claim 6, further comprising an additional power divider to split the first co-phased component signal of the first signal to drive the at least two radiating elements of the first polarization state, and and to further split the first anti-phased component signal of the second signal.

8. The dual-polarized antenna array of claim 1, wherein the at least two radiating elements of the second polarization state are inclined at angles away from an angle perpendicular to a plane of an array face ground plane of the dual-polarized antenna array.

9. The dual-polarized antenna array of claim 1, further comprising:

at least one antenna element for a second frequency band, wherein the dual-polarized antenna array comprises a dual-stack arrangement with a first stack that includes the at least one unit cell and a second stack that includes the at least one antenna element for the second frequency band.

10. The dual-polarized antenna array of any of claim 1, wherein the unit cell further comprises:

a third radiating element of the second polarization state, wherein the third radiating element of the second polarization state is positioned between the at least two radiating elements of the second polarization state.

11. A method for using a dual-polarized antenna array, comprising:

receiving a first signal of a first frequency band for transmission at a first 45 degree slant linear polarization;

splitting the first signal into a first co-phased component signal and a second co-phased component signal;

receiving a second signal of the first frequency band for transmission at a second 45 degree slant linear polarization, wherein the second 45 degree slant linear polarization is orthogonal to the first 45 degree slant linear polarization;

splitting the second co-phased component signal into a first anti-phased component signal and a second anti-phased component signal;

driving at least one radiating element of a first polarization state with the first co-phased component signal and the first anti-phased component signal;

driving at least two radiating elements of a second polarization state with the second co-phased component signal and the second anti-phased component signal, wherein the at least one radiating element of the first polarization state and the at least two radiating elements of the second polarization state are components of a unit cell of the dual-polarized antenna array;

driving a first cross-dipole of at least one dual-polarized cross-dipole antenna element of the dual-polarized antenna array with a copy of the first signal; and driving a second cross-dipole of the at least one dual-polarized cross-dipole antenna element with a copy of the second signal, wherein the at least on dual-polarized cross-dipole antenna element and the at least one unit cell are oriented vertically along a length of the dual-polarized antenna array.

12. The method of claim 11, where the first polarization state is a horizontal linear polarization and the second polarization state is a vertical linear polarization.

13. The method of claim 11, where the first polarization state is a vertical linear polarization and the second polarization state is a horizontal linear polarization.

14. The method of claim 11, wherein the at least two radiating elements of the second polarization state are displaced on a first side and a second side of the at least one radiating element of the first polarization state.

15. The method of claim 11, where the first signal and the second signal are designed to be either orthogonally circular polarized, orthogonally elliptical polarized or other orthogonally linear polarized states.

16. The method of claim 11, wherein the at least one radiating element of the first polarization state comprises:

at least two radiating elements of the first polarization state.

17. The method of claim 16, further comprising:

splitting the first co-phased component signal of the first signal and splitting the first anti-phased component signal of the second signal to drive the at least two radiating elements of the first polarization state.

* * * * *